US010894588B2

(12) United States Patent
Roberts et al.

(10) Patent No.: US 10,894,588 B2
(45) Date of Patent: Jan. 19, 2021

(54) MAGNETIC PHASE TRANSITION EXPLOITATION FOR ENHANCEMENT OF ELECTROMAGNETS

(71) Applicant: Thales Holdings UK Plc, Reading (GB)

(72) Inventors: Sasha Roberts, Somerset (GB); Andrew Bond, Templecombe (GB)

(73) Assignee: THALES HOLDINGS UK PLC, Reading (GB)

( * ) Notice: Subject to any disclaimer, the term of this patent is extended or adjusted under 35 U.S.C. 154(b) by 616 days.

(21) Appl. No.: 15/596,527

(22) Filed: May 16, 2017

(65) Prior Publication Data

US 2017/0334532 A1 Nov. 23, 2017

(30) Foreign Application Priority Data

May 17, 2016 (GB) ..... 1608685.2

(51) Int. Cl.

| | |
|---|---|
| ***B63G 7/06*** | (2006.01) |
| ***H01F 7/20*** | (2006.01) |
| *H01F 1/147* | (2006.01) |
| *H01F 1/34* | (2006.01) |

(52) U.S. Cl.
CPC ..... *B63G 7/06* (2013.01); *H01F 7/202* (2013.01); *H01F 1/14708* (2013.01); *H01F 1/34* (2013.01)

(58) Field of Classification Search
None
See application file for complete search history.

(56) References Cited

U.S. PATENT DOCUMENTS

| | | | | |
|---|---|---|---|---|
| 2,270,694 | A | 1/1942 | Yancey | |
| 3,802,935 | A | 4/1974 | Martin et al. | |
| 3,906,884 | A * | 9/1975 | Gould | B63G 7/02 114/244 |
| 5,361,675 | A | 11/1994 | Spektor et al. | |
| 6,213,021 | B1 | 4/2001 | Pickett | |
| 7,658,149 | B2 | 2/2010 | Theobald et al. | |
| 8,750,774 | B2 * | 6/2014 | Gon | G03G 15/2053 399/320 |
| 2002/0017628 | A1 * | 2/2002 | Akimoto | H01F 1/36 252/62.56 |
| 2005/0212630 | A1 * | 9/2005 | Buckley | A61B 17/12022 335/35 |

(Continued)

FOREIGN PATENT DOCUMENTS

| | | | |
|---|---|---|---|
| DE | 977801 | * | 7/1970 |
| EP | 0083166 | A2 | 7/1983 |

(Continued)

OTHER PUBLICATIONS

Search Report in GB Application No. GB1608685.2, dated Dec. 28, 2017.

(Continued)

*Primary Examiner* — Stephen Johnson
(74) *Attorney, Agent, or Firm* — Hauptman Ham, LLP

(57) ABSTRACT

An electromagnet can be used to provide a controlled magnetic field, for example for the purpose of minesweeping. The electromagnet is constructed of a material which has a Curie temperature, such that the electromagnet can be stored at a temperature above the Curie temperature, but deployed below the Curie temperature in use.

16 Claims, 4 Drawing Sheets

(56) References Cited

U.S. PATENT DOCUMENTS

| | | | | |
|---|---|---|---|---|
| 2006/0088324 | A1 | 4/2006 | Fujimoto et al. | |
| 2011/0227677 | A1* | 9/2011 | Coombs | H01F 6/006 335/284 |
| 2015/0049588 | A1* | 2/2015 | Lambertus | G05D 1/0206 367/93 |

FOREIGN PATENT DOCUMENTS

| | | | |
|---|---|---|---|
| JP | 54156399 | A | 12/1979 |
| JP | 5970308 | U | 5/1984 |
| JP | 624381 | A | 2/1994 |
| JP | 2001080576 | A | 3/2001 |
| JP | 2004080119 | A | 3/2004 |
| JP | 2004306683 | A | 11/2004 |
| JP | 3671726 | B2 | 7/2005 |
| JP | 2006295122 | A | 10/2006 |
| JP | 2011228487 | A | 11/2011 |
| KR | 101089118 | B1 | 12/2011 |
| KR | 20130088975 | A | 8/2013 |
| WO | 2013015074 | A1 | 1/2013 |
| WO | 2014003061 | A1 | 1/2014 |

OTHER PUBLICATIONS

Ferrite Product Specification 3E5 Material Specification, Sep. 1, 2008, https://ferrite.ru/uploads/pdf/products/ferroxcube/materials/3e5.pdf, Last Checked on Mar. 24, 2018.

Notification of Reason(s) for Rejection issued in corresponding Japanese Patent Application No. 2017-094722 dated Oct. 2, 2018, pp. 1-2.

M.S. Leu et al., "The Determination of Curie Temperature by Differential Scanning Calorimetry Under Magnetic Field," Transactions on Magnetics, Nov. 1991, pp. 5,414-5,416, vol. 27, No. 6.

Henry W. Williams et al., "Determination of Curie, Neel, or Crystallographic Transition Temperatures via Differential Scanning Calorimetry," Analytical Chemistry, Dec. 1969, pp. 2,084-2,086, vol. 41, No. 14.

K. Fabian et al., "Measuring the Curie temperature," Geochemistry Geophysics Geosystems, Apr. 24, 2013, pp. 947-961, vol. 14, No. 4, American Geophysical Union.

Combined Search and Examination Report for United Kingdom Application No. GB1608685.2, dated Oct. 24, 2016.

Ferrite Product Specification 3E8 Material Specification, Sep. 2008, http://www.ferroxcube.com/FerroxcubeCorporateReception/datasheet/3e8.pdf, Last Checked on May 16, 2017.

Ferrite Product Specification 3E25 Material Specification, Sep. 2008, http://www.ferroxcube.com/FerroxcubeCorporateReception/datasheet/3e25.pdf, Last Checked on May 16, 2017.

Ferrite Product Specification 3E55 Material Specification, Sep. 2008, http://www.ferroxcube.com/FerroxcubeCorporateReception/datasheet/3e55.pdf, Last Checked on May 16, 2017.

Ferrites and accessories, SIFERRIT material M13, Sep. 2006, http://en.tdk.eu/blob/528872/download/4/pdf-m13.pdf, Last Checked on May 16, 2017.

Ferrites and accessories, SIFERRIT material T66, Sep. 2006, http://en.tdk.eu/blob/528872/download/4/pdf-m13.pdf, Last Checked on May 16, 2017.

* cited by examiner

MAGNETIC PHASE TRANSITION EXPLOITATION FOR ENHANCEMENT OF ELECTROMAGNETS

CROSS-REFERENCE TO RELATED APPLICATIONS

This application is based upon and claims the benefit of priority from prior United Kingdom Application number 1608685.2 filed on May 17, 2016, the entire contents of which are incorporated herein by reference.

FIELD

Embodiments described herein relate to electromagnets and in particular to electromagnets for use in mine-sweeping systems and mine countermeasure vessels.

BACKGROUND

A mine countermeasure vessel (MCMV) is a type of ship designed to search for and, if necessary, destroy underwater mines. Mines of a particular type are triggered by detected alterations in proximate magnetic field. These magnetically triggered mines operate on the principle that seaworthy vessels have a detectable magnetic signature; on detection of such a ship in proximity of the mine, a mine will trigger and detonate.

Typically, a MCMV deploys a mine sweeping module which creates a magnetic field, thereby triggering nearby mines. A mine sweeping module is generally deployed in the water from an MCMV, tethered by a cable. The module may be allowed to sink beneath the water, may float, or may be suspended from a surface float. The tethering cable allows the module to be dragged behind the MCMV as it moves forward.

By creating a magnetic field, the mine sweeping module mimics the magnetic signature of a vessel and enables the mine to be triggered safely, without damage to a ship. The larger the magnetic field that can be created by the mine-sweeping module, the larger the magnetic signature of the vessel which can be emulated.

In order to reduce risk that the host MCMV will itself trigger a mine, the MCMV is configured to have a low magnetic signature. Further, in operation, the mine sweeping module is deployed at a large enough distance from the MCMV that danger to the MCMV itself is minimised and no damage results from the triggering of mines by the mine sweeping module.

SUMMARY

According to a first aspect, there is provided a system for emitting a controlled magnetic field, said system comprising:

an electromagnet comprising a magnetic core, wherein the core comprises a ferromagnetic or ferrimagnetic material;

storage means for storing said electromagnet; and heating means for heating said magnetic core, wherein the heating means are operable to heat the magnetic core above its Curie temperature for storage by said storage means.

In some embodiments, the heating means are integral with the storage means.

In some embodiments, the core is removable from said electromagnet for heating by said heating means.

In some embodiments, the heating means are integral with said magnetic core.

The heating means may comprise a cartridge heater.

In some embodiments, the core comprises one or more bores. The heating means may be located in one or more bores. Alternatively, the bores may comprise a heating fluid or heat transfer fluid. The fluid may comprise engine exhaust gases.

In some embodiments, the system comprises an insulating material at least partially surrounding the core.

In some embodiments, the Curie temperature of the magnetic core lies in the range 0° C. to 100° C. In some embodiments, the Curie temperature of the magnetic core lies in the range 50° C. to 100° C.

In some embodiments, the magnetic core comprises a ferrite. The magnetic core may comprise a single crystal ferrite.

The magnetic core may comprise at least one material selected from manganese arsenide, gadolinium, chromium (IV) oxide, yttrium iron, terbium iron alloy, nickel 30 iron alloy, cuprospinel, nickel manganese alloy with 25% manganese, nickel 70 copper alloy, silverin 400, manganese zinc ferrites, nickel zinc ferrite, manganese copper ferrite, lanthanum strontium manganite, and YAlFe garnet ferrite.

In some embodiments, the storage means form part of a mine countermeasures vessel.

In some embodiments, the system further comprises means for enabling heat to be dissipated from the magnetic core. Said means for enabling heat to be dissipated may comprise means for enabling heat to be dissipated to seawater.

In some embodiments, the system further comprises a temperature sensor.

In some embodiments, the electromagnet is comprised within a minesweeping module and the storage means comprises means for storing the minesweeping module.

In an embodiment, there is provided a mine countermeasures system comprising the system for emitting a controlled magnetic field.

In an embodiment, there is provided a mine countermeasures vessel comprising the system for emitting a controlled magnetic field.

According to a second aspect, there is provided a method of storing an electromagnet, wherein said electromagnet comprises a magnetic core, wherein said magnetic core comprises ferromagnetic or ferrimagnetic material, the method comprising:

switching off electrical power to the electromagnet;

heating the magnetic core to a temperature above the Curie temperature of the magnetic core; and storing the magnetic core at said temperature.

In some embodiments, the Curie temperature of the magnetic core lies in the range 0° C. to 100° C. In some embodiments, the Curie temperature of the magnetic core lies in the range 50° C. to 100° C.

According to a third aspect, there is provided an electromagnet comprising a magnetic core, wherein said magnetic core comprises ferromagnetic or ferrimagnetic material, and wherein the Curie temperature of said magnetic core lies in the range 0° C. to 100° C.

In some embodiments, the Curie temperature of the magnetic core lies in the range 50° C. to 100° C.

In some embodiments, the magnetic core comprises a ferrite. The magnetic core may comprise a single crystal ferrite. The magnetic core may comprise at least one material selected from manganese arsenide, gadolinium, chromium (IV) oxide, yttrium iron, terbium iron alloy, nickel 30 iron alloy, cuprospinel, nickel manganese alloy with 25% manganese, nickel 70 copper alloy, silverin 400, manganese zinc ferrites, nickel zinc ferrite, manganese copper ferrite, lanthanum strontium manganite, and YAlFe garnet ferrite.

In an embodiment, there is provided a minesweeping module for deployment from a minesweeping vessel, said minesweeping module comprising the electromagnet.

DETAILED DESCRIPTION

Figure 1:
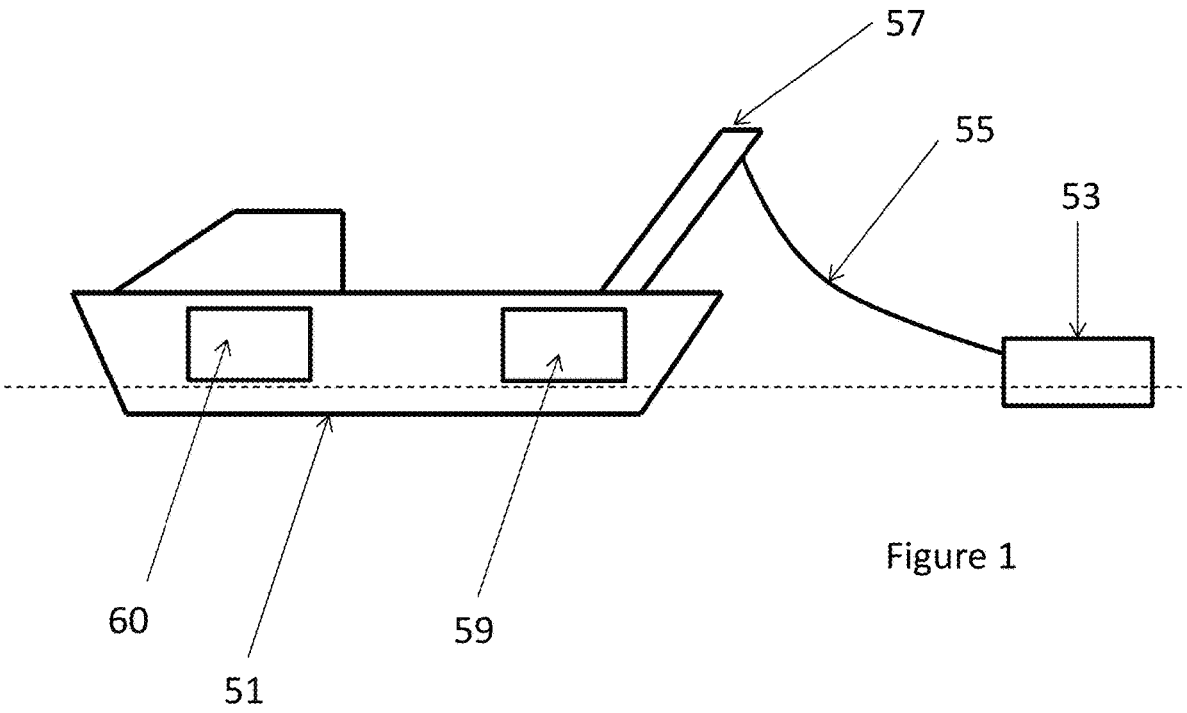
FIG. 1 is a schematic diagram of an MCMV deploying a mine sweeping module in accordance with a described embodiment.

In general terms, embodiments herein relate to a deployable mine sweeping module which, when not in deployment, is stored on an MCMV. In order to reduce risk of the MCMV triggering mines while the mine sweeping module is being stored on it, mine sweeping modules in accordance with embodiments described herein are designed such that they do not significantly alter the magnetic signature of the MCMV.

For effective operation while minimising risk to the host MCMV, therefore, it is desirable that a mine sweeping module according to an embodiment should create a large magnetic field when deployed from the MCMV (thereby increasing likelihood of triggering nearby magnetically triggered mines) but a small or negligible magnetic field while stored on the vessel.

By way of background, it will be understood by the reader that large permanent magnets provide a large magnetic field but cannot be stored on mine-countermeasures vessels without compromising the magnetic signature of the host vessel.

Further, as an alternative to permanent magnets, electromagnets are known for use in mine countermeasure vessels. Electromagnets can be switched on after deployment of the minesweeping vessel and switched off for storage. Power to an electromagnet-based mine sweeping module is supplied via cables which extend from the host vessel to the mine sweeping module.

An air core electromagnet does not have a significant magnetic signature once it is switched off. Therefore, a mine sweeping module based on an air core electromagnet can be deployed on an MCMV with no substantial effect on the magnetic signature of the host vessel. However, the magnetic fields created by air-core electromagnets are typically relatively weak and therefore, in order to emulate vessels with high magnetic field signatures, it is necessary to provide either a relatively large electromagnet or one driven by a relatively large power supply.

Electromagnets with ferromagnetic or ferrimagnetic cores typically emit stronger magnetic fields than air core electromagnets of comparable size. However, the magnetic permeability of the core may be non-negligible when the electromagnet is switched off. The core can therefore contribute to the magnetic signature of the MCMV when stored on board.

Electromagnets with ferromagnetic cores such as iron or steel are capable of producing a larger magnetic field than those with an air core but the average permeability of the cores is relatively large and may compromise the magnetic signature of the host vessel to an unacceptable level.

As a result, the average magnetic relative permeability of the core of the electromagnet must be sufficiently low so as not to compromise the safety of the vessel. In practice, this would be done by imposing an upper limit on core relative magnetic permeability. If such an electromagnet were to be deployed on a HUNT class vessel, this upper limit would be 1.05, and for SANDOWN class vessels it would be 1.35. With such limits on core magnetic permeability, the strength of the electromagnet would not be increased significantly above that of an air core.

In order to emulate large vessels, therefore, air core and core electromagnets with suitably low magnetic permeability must therefore be made large, use more power or be constructed with more cable. However, large electromagnets may be difficult to store and deploy due to their physical size and weight. High power electromagnets are expensive to operate.

Embodiments therefore seek to provide a mine sweeping module capable of creating a relatively strong magnetic field, in comparison with electromagnetic deployments, while having a substantially negligible impact on the magnetic signature of the host vessel when inactive and stored thereon.

FIG. 1 shows a crude schematic diagram of a mine countermeasures vessel according to an embodiment. The vessel comprises a ship 51 from which a minesweeping module 53 is deployed. The minesweeping module comprises an electromagnet. Power is supplied to the electromagnet and module via a cable or cables 55 extending from the ship 51. The ship further comprises a means 57 of deploying and removing the module from the water. The skilled person will understand that a variety of such means are suitable for deploying the minesweeping module from the ship. When not in use the minesweeping module 53 is stored by storage means 60 on the vessel 51 with the electromagnet switched off.

Figure 2:
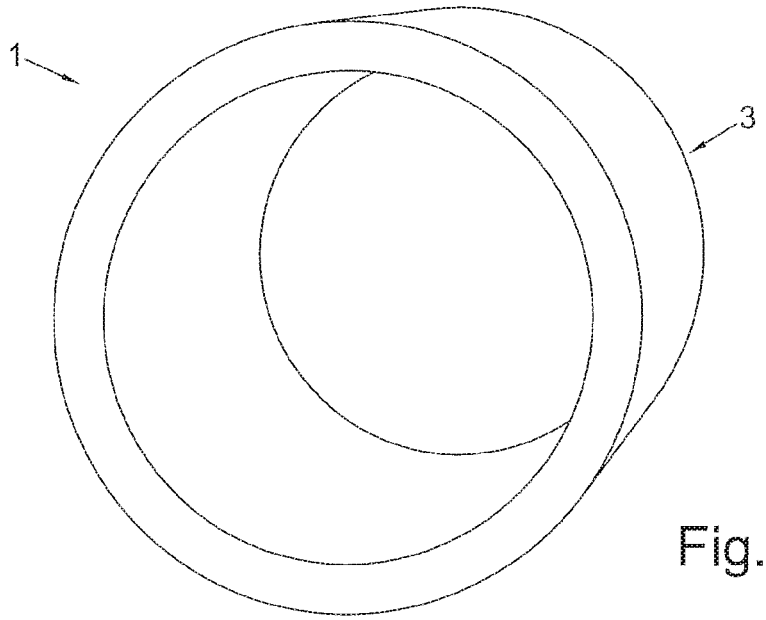
FIG. 2 is a schematic diagram of an air-core solenoid electromagnet.

FIG. 2 shows a schematic representation of an electromagnet 1 which is typically employed in minesweeping modules or systems. The electromagnet of FIG. 1 is an air core electromagnet and comprises a solenoid 3. The solenoid comprises a loop of wire wound into a helix. The electromagnet as illustrated takes the form of a cylindrical solenoid. However, the reader will appreciate that other shapes could be employed, for instance to meet mounting requirements or to create alternatively shaped magnetic fields.

Figure 3:
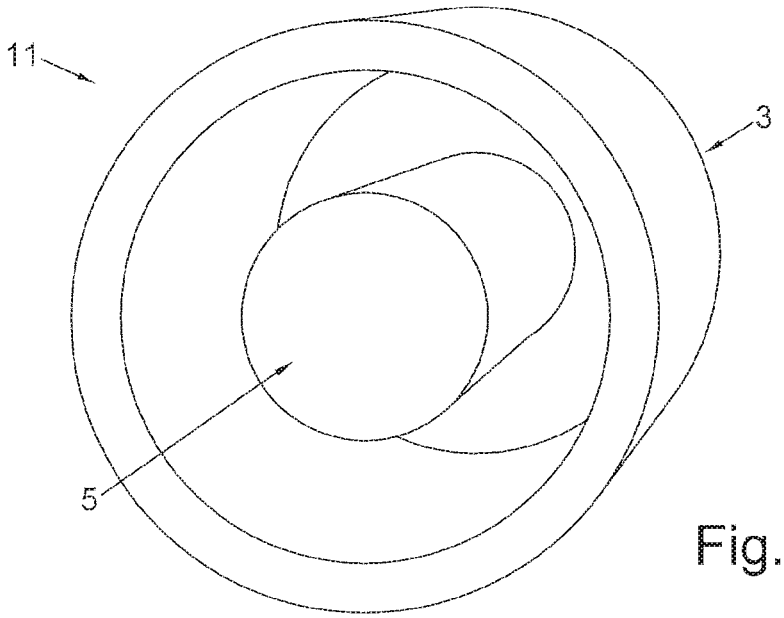
FIG. 3 is a schematic diagram of a solenoid electromagnet of a described embodiment.

FIG. 3 shows a schematic representation of a solenoid electromagnet 11 according to an embodiment of the present invention. In an embodiment, the electromagnet 11 comprises a core 5. The solenoid 3 is wound around the core 5. The core 5 comprises a piece of magnetic material. The core 5 shown in FIG. 3 is a straight cylindrical rod. However, other core structures may be employed. Further, other core-coil configurations may be employed.

In an embodiment, the core 5 comprises ferrimagnetic or ferromagnetic material.

Ferrimagnets and ferromagnets are magnetically ordered compounds. In ferromagnets the magnetic dipoles of atoms or ions within the metal are aligned and therefore contribute a net magnetic moment. Ferrimagnets, in contrast, comprise atoms or ions with opposing magnetic dipoles. However, the opposing magnetic moments are unequal and therefore a net magnetic moment remains.

Above a particular temperature, the ordering of the magnetic spins in a ferrimagnetic or ferromagnetic material is disrupted by thermal energy and the ordering of magnetic dipoles is lost. At this temperature, the compound becomes paramagnetic and does not exhibit spontaneous magnetisation. This temperature is known as the Curie temperature.

In an embodiment, an electromagnet with a core comprising a ferrimagnetic material or a ferromagnetic material with a low Curie temperature is provided. In an embodiment the Curie temperature lies in the range 0° C. to 100° C. (273K to 373K).

Below the Curie temperature, ferrimagnetic and ferromagnetic cores increase the magnetic field produced by electromagnets relative to their air-core equivalents. Above the Curie temperature, ferrimagnetic and ferromagnetic cores have a negligible impact on the magnetic field of an electromagnet and the strength of such electromagnets is substantially equal to that of an air core.

Embodiments described herein exploit this effect. Because the Curie temperature is low, in addition to the control of magnetic field obtained by passing electrical current through the solenoid of an electromagnet, it is also possible to control the magnetic field by controlling the temperature of the magnetic core with respect to the Curie temperature. Electromagnets according to this embodiment may therefore be employed in situations where precise control of the magnetic field produced by an electromagnet is necessary.

As explained above, mine countermeasures vessels are an example of one such situation. In an embodiment, the magnetic field produced by the electromagnet in a mine-sweeping module is controlled by heating the magnetic core of the electromagnet so that it can be safely stored on a mine countermeasures vessel.

Figure 4:
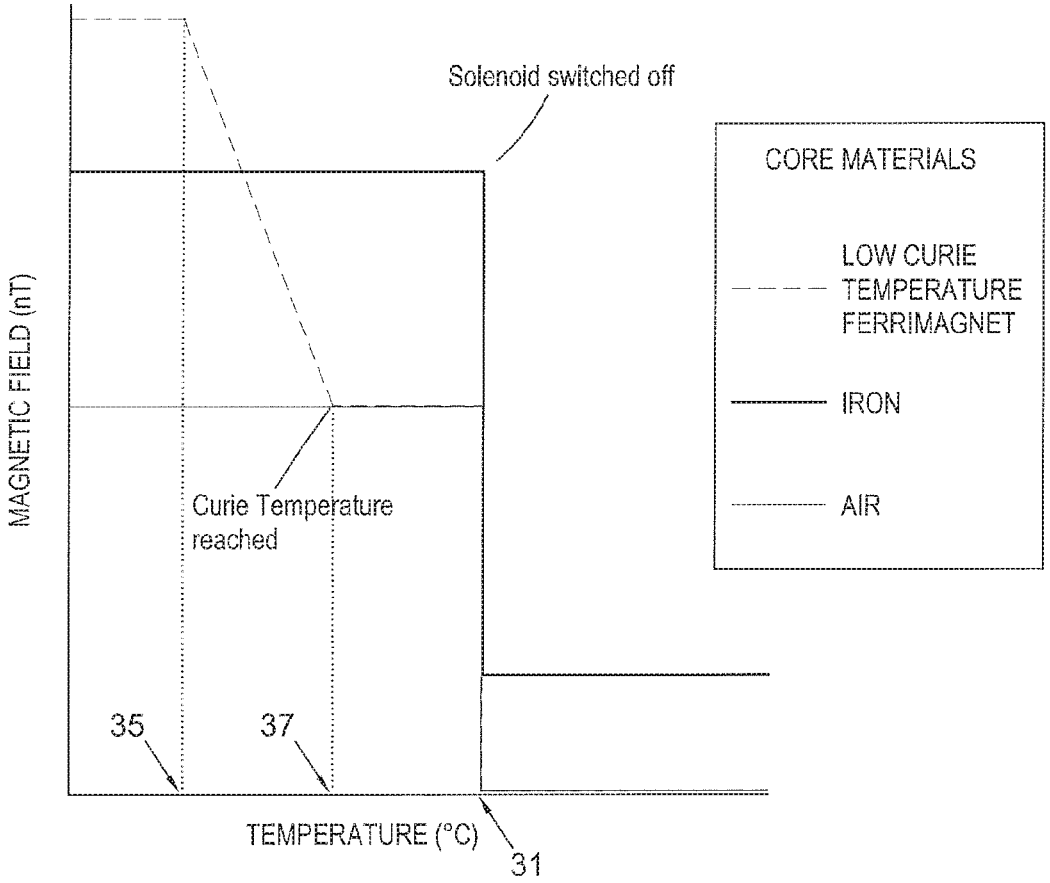
FIG. 4 is a graph showing magnetic field against temperature for the electromagnet of FIG. 3.

FIG. 4 shows a schematic representation of the magnetic field produced by solenoid electromagnets comprising three different core materials: an air core (i.e. no core), an iron core and a low Curie temperature ferrimagnetic core according to an embodiment. The y-axis indicates the magnetic field measured outside of the solenoid. The x-axis indicates the temperature of the core of the electromagnet. The graph shows the effect on the magnetic field of increasing temperature and switching off the solenoid at a given temperature 31. The reader will appreciate that the figure is a simplification and disregards secondary effects created by increased conductor temperature. In fact, the device may perform better if held just below the Curie temperature as the magnetic permeability is typically highest at this point.

In the case of the air core, the magnetic field is constant as temperature increases and drops to zero when the solenoid is switched off at temperature 31.

Iron is a ferromagnetic material with a Curie temperature of 1043K. The temperature 31 is well below 1034K. At all temperatures shown in the graph, the magnetic field of the electromagnet comprising an iron core is higher than that of the air core due to its magnetic permeability. The magnetic field is largely invariant to temperature over these scales.

Upon switching off the solenoid at temperature 31, however, the magnetic field of the iron-core electromagnet drops sharply. In contrast with the air core, however, the magnetic field drops to a non-zero value as the iron core remains magnetic.

The dashed line shows the magnetic field of an electromagnet according to an embodiment. The electromagnet comprises a ferro- or ferrimagnetic core with Curie temperature 37. The Curie temperature 37 is lower than the temperature 31 at which the solenoid is switched off. In this embodiment, at low temperatures, the magnetic field produced by the electromagnet comprising this core is higher than that of both the air core and the iron core. As the temperature increases above temperature 35, however, the magnetic field decreases as the thermal energy starts to cause disruption of the ordering of the magnetic moments within the ferro/ferrimagnetic material. At the Curie temperature 37 the magnetic field becomes substantially equal to that of an air core, both when the solenoid is switched on and after it is switched off. Consequently, the magnetic field remains constant until the solenoid is switched off at temperature 31, after which it becomes substantially zero.

As demonstrated in FIG. 3, by controlling the temperature of the magnetic core, it is therefore possible to obtain a mine sweeping module that emits a strong magnetic field in use but substantially zero magnetic field when stored.

In an embodiment, the core of the electromagnet forming part of the minesweeping module is cooled below its Curie temperature during deployment. As follows from FIG. 3, the magnetic field produced by the mine-sweeping module therefore is large when the electromagnet is switched on. The magnetic signature of large vessels can therefore be emulated without the need to employ a large or very high power electromagnet.

For storage of the mine-sweeping module on the MCMV, however, the electromagnet is switched off and the core of the electromagnet is heated above its Curie temperature 37. The temperature of the core is maintained above its Curie temperature throughout storage. The magnetic field produced by the mine sweeping module is therefore negligible at all times during storage. Thus, the magnetic signature of the MCMV is unaffected by storage of a mine-sweeping module according to this embodiment. Note that this is in contrast to the iron core electromagnet of FIG. 3, which emits a non-negligible magnetic field when the solenoid is switched off. An electromagnet comprising such a core is therefore unsuitable for storage on a mine countermeasure vessel as it would compromise the magnetic signature of the vessel. The amount of heat energy required to heat the iron core to above its Curie temperature is too high for this method of control to be employed viably on a vessel.

Thus, by exploiting the Curie temperature of the core material, control of the magnetic permeability of an electromagnetic core is possible. This allows for a small, light magnetic sweep module capable of producing a strong magnetic field during deployment but which does not compromise the host vessel magnetic signature.

Figure 5:
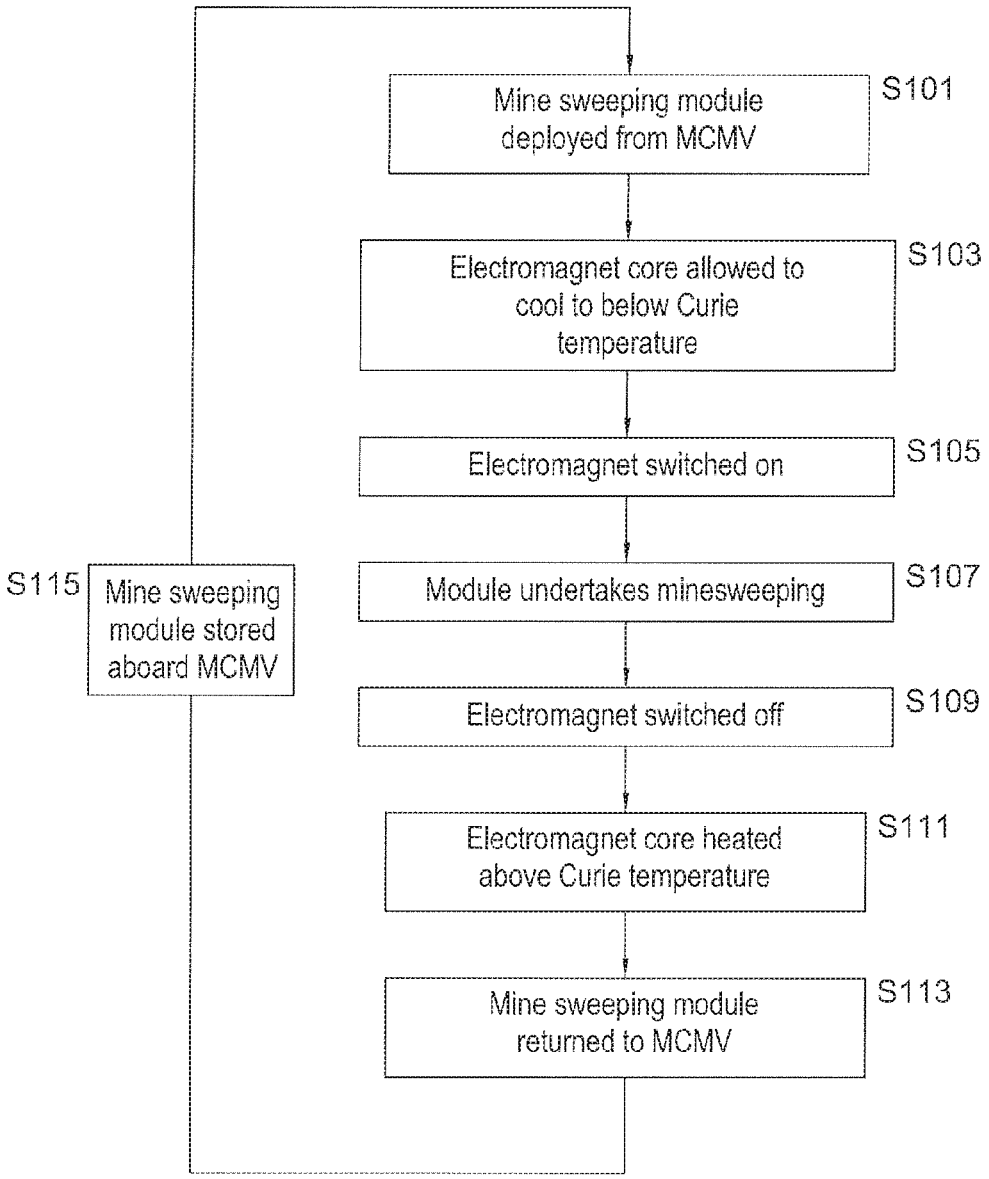
FIG. 5 is a process flow diagram for a method of using the electromagnet of the described embodiment.

FIG. 5 shows a flow diagram for deployment and storage of a mine-sweeping module according to an embodiment.

In step S101, the mine sweeping module is deployed from the mine countermeasures vessel. In an embodiment, the deployment includes disconnection of the core of the electromagnet from a heat or power source on the MCMV.

In step S103, the electromagnetic core is allowed to cool to below the Curie temperature. In an embodiment, this comprises waiting for the core to cool naturally until it reaches a temperature below its Curie temperature.

This can be achieved by positioning a temperature sensor within the system. Alternatively, calibration tests can be performed on the equipment, prior to installation, to determine how quickly the core will cool down naturally in ambient conditions, and providing the operator with appropriate instructions as to these cooling times. It may be appropriate to test the cooling rate at various different ambient conditions, mindful that air temperature can vary substantially. In that case, the operator may be provided with a table of cooling times against ambient temperature.

In another embodiment, the core is cooled with seawater.

In an embodiment, the core is insulated from the seawater so that cooling occurs slowly enough following removal of the heat source to enable the mine sweeping module to be deployed at a safe distance from the mine countermeasures vessel. In addition, an insulator will reduce heat loss during storage, with resultant saving in power demand.

Note that in these embodiments, the Curie temperature of the core must be higher than that of the conditions under which the mine sweeping module is deployed for use.

In step S105, the electromagnet is switched on for mine sweeping.

In step S107, the mine sweeping module performs mine sweeping.

In step S109, the mine sweeping module is switched off.

In step S111, the electromagnetic core is heated above its Curie temperature. Heating, and maintenance of the temperature of the core at a level above the Curie temperature, can be achieved in several ways.

In general, the core could be heated either in situ or after removal thereof from the coil of the electromagnet.

In one embodiment, heating is achieved using heaters within or around the core itself.

These heaters can be connected to a power source generated by the vessel.

To inject heat energy into the body of the core, the core may comprise bores, into which heat may be conveyed. For instance, cartridge heaters can be inserted into bores of the core. Suitable electrical heaters of this type could be powered locally, such as from batteries, or from the vessel's own power generation facilities.

In another approach, the bores may allow introduction of heat transfer fluid. Suitable fluids may be liquid (such as water, aqueous solutions, organic compounds such as oils) or gaseous (such as air, engine exhaust gases). To enable circulation, the bores may be through bores, defining a fluid flow pathway through the core.

It will be noted that engine exhaust gases may be a convenient and opportunistic source of heat on a vessel. The use of the heat conveyed in such exhaust gases will act to reduce need for other sources of heat, with consequent energy consumption, but other arrangements for maintaining the core above the Curie temperature also need to be provided for circumstances when exhaust gases are not available, such as when the vessel's engines are not running. Back-up power generation facilities (such as batteries or other energy storage means) may need to be considered, in the event that a vessel's power generation facilities are normally dependent on the running of the engines.

As noted above, the core could be detachable from the rest of the electromagnet, and capable of being removed to a facility 59 devoted to maintenance of the temperature of the core above the Curie point. This facility 59 could take the form of a heated bath, a chamber in which heated gases (such as exhaust gases) flow, or electrical heaters. Heaters could be placed in a blanket to cover the core, or in an oven in which the core can be contained.

In one approach, cartridge heaters are employed, although pumping heated fluids through holes in the core would also be possible. Heaters could therefore be electrical or fluid based. Heating fluid could comprise water or even hot exhaust gases, although a continual supply of heat would be required even in port so engine heat may only be suitable for supplementing the heaters to save power.

In another embodiment, the core is removable from the electromagnet and is heated in another location. In an embodiment, conventional heaters are employed to heat the core of the electromagnet. In yet another embodiment, heat from the ship's exhaust is employed to heat the core which has been removed from the electromagnet.

In step S113, the mine sweeping module is returned to the mine countermeasures vessel for storage.

In step S115, the core is maintained at temperatures above the Curie temperature while the mine sweeping module is stored aboard the mine countermeasures vessel. The core is maintained at these temperatures until the module is required for deployment, in which case the cycle returns to step S101.

The precise material employed within the core is not particularly limited beyond the requirement that the Curie temperature lies above the normal operating temperature of the minesweeping module but low enough that it may be heated above the Curie temperature without significant energy expenditure and therefore cost. Typically, a core material having a Curie temperature in the range 0° C. to 100° C. will be preferable. For use in warm climates, it may be preferable that the core material has a Curie temperature which lies in the range 50° C. to 100° C. Ideally, for maximum performance of the electromagnet, the Curie temperature will lie just above the operating temperature of the minesweeping module. This allows that the core can be heated above the Curie temperature as quickly as possible, and that the magnetism of the core is substantially eliminated without significant lag. The reader will appreciate that the operator needs to be mindful that heating of the core will inevitably lead to temperature gradients between the outer surface of the core and the interior thereof, as the temperature of the core is brought up to the super-Curie level. It may be that the outer surface of the core exceeds the Curie temperature, whereas the interior is below. So, the operator needs to appreciate that a temperature measurement on the outside of the core may give a false sense of security that the magnetism of the core has ceased.

Aside from the requirement of a low Curie temperature, the material employed in the core should preferably not be dangerous to the environment, for example the material should not be on the Montreal Protocol list. The core material may be subject to underwater explosive shocks—due to detonation of mines—therefore, preferably the material performance of the core will not be affected by fractures or breaks due to shocks.

Examples of materials suitable for use in the electromagnet core include ferrites. The material performance of ferrites has been shown to be resilient to shocks due to their polycrystalline construction. Further, single crystal ferrites have a very high magnetic permeability but also maintain a very small magnetic remanence.

In selecting a suitable core material, it would be desirable to achieve a high saturation level. In addition, high magnetic permeability would be a desirable quality.

Further examples of materials suitable for use in magnetic cores according to embodiments include: manganese arsenide, gadolinium, chromium (IV) oxide, yttrium iron, terbium iron alloy, nickel 30 iron alloy, cuprospinel (copper ferrite), nickel manganese alloy with 25% manganese, nickel 70 copper alloy, silverin 400 (nickel copper (30%) iron alloy), manganese zinc ferrites, nickel zinc ferrites, manganese copper ferrites, lanthanum strontium manganite, and YAlFe garnet ferrite. $Ni_2Mn$—X (X=Ga, Co, In, Al, Sb) Heusler alloys have low Curie temperatures and are used in magnetic refrigeration.

In an embodiment, a material is chosen which has a Curie temperature above the standard operating temperatures of the mine sweeping module/system but low enough that excessive power is not required to heat the core.

In an embodiment, at the operational temperature of the magnetic sweep module, the magnetic material is close to but has not reached its saturation magnetisation. In another embodiment, the Curie temperature of the core must be suitably low so as not to place onerous power requirements on the host vessel in order to heat the core above the Curie temperature. In an embodiment, the Curie temperature is high enough that it is above the ambient seawater temperature of the environment in which the mine sweeping module is deployed. This ensures that the core of the electromagnet remains below its Curie temperature during deployment.

The reader will recognise from the above disclosure that, in order to implement an embodiment, the Curie temperature of the core should be known, at least approximately. A suitable method of measuring the Curie temperature can be found in "Measuring the Curie temperature" (K. Fabian, V. P. Shcherbakov, S. A. McEnroe, Geochemistry, Geophysics, Geosystems, vol. 14, issue 4, April 2013).

A standard technique for measuring the Curie temperature is known as Differential Scanning calorimetry (DSC) analysis. This is described, for instance, in the following two publications:

Determination of Curie, Neel, or crystallographic transition temperatures via differential scanning calorimetry (Williams, H. W, Chamberland, B. L., Anal. Chem., 1969, 41 (14), pp 2084-2086);

The determination of Curie temperature by differential scanning calorimetry under magnetic field (Leu, M. S.; Tsai, C. S.; Lin, C. S.; Lin, S. T.; Magnetics, IEEE Transactions on, vol. 27, issue 6).

Various materials are commercially available which enable implementation of an embodiment as described herein. Suitable examples will now be described with reference to table 1 below:

TABLE 1

| Material Name | Chemical Formula | Manufacturer + datasheet | Curie Temperature (° C.) |
|---|---|---|---|
| Manganese Arsenide | MnAs | | 46 |
| Gadolinium | Gd | | 20 |
| Chromium (IV) Oxide | $CrO_2$ | | 114 |
| Yttrium Iron | $Y_2Fe_{17}$ | | 30 |
| Nickel 30 Iron Alloy | Ni-30% Fe-70% | | 70 |
| Cuprospinel (Copper Ferrite) | $CuFe_2O_4$ | | ~20-30 |
| Nickel Manganese alloy-25% Mn | NiMn | | 27 |
| Nickel 70 Copper Alloy | Ni-70% Cu-30% | | 10-100 |
| Silverin 400 = Nickel Copper(30%) Iron Alloy | Ni:Cu:Fe | | 50 |
| Lanthanum Strontium Manganite | $La_{0.65}Sr_{0.35}MnO_3$ | | 0-95 |
| 3E5 Ferrite | | Ferroxcube http://www.ferroxcube.com/FerroxcubeCorporateReception/datasheet/3e5.pdf | 125 |
| 3E8 Ferrite | | Ferroxcube http://www.ferroxcube.com/FerroxcubeCorporateReception/datasheet/3e8.pdf | 100 |
| 3E25 Ferrite | | Ferroxcube http://www.ferroxcube.com/FerroxcubeCorporateReception/datasheet/3e25.pdf | 125 |
| 3E55 Ferrite | | Ferroxcube http://www.ferroxcube.com/FerroxcubeCorporateReception/datasheet/3e55.pdf | 100 |
| M13 Ferrite | Nickel Zinc Ferrite | EPCOS/TDK http://en.tdk.eu/blob/528872/download/4/pdf-m13.pdf | 105 |
| 166 Ferrite | Manganese Zinc Ferrite | EPCOS/TDK http://en.tdk.eu/blob/528852/download/4/pdf-t66.pdf | 100 |

Of course, the reader will need to assess which of these materials meets other constraints, such as on mass, mechanical strength, cost and availability, which are not germane to the present disclosure.

Although the above description has focussed on mine countermeasures systems, the person skilled in the art will appreciate that systems and methods according to the above described embodiments can be employed anywhere that that has strict magnetic signature requirements but requires a higher magnetic field than can be achieved with an air core electromagnet. One such example in the space sector is the control of magnetic fields in satellites.

Satellite systems require highly magnetically clean environments to ensure no interference with sensors (such as magnetometers). In certain circumstances, it may be desirable to provide mechanical actuation in on-board equipment. One way in which mechanical actuation is commonly achieved is with the use of solenoids. Size and mass constraints may not permit the use of air-core solenoids, meaning that, in order to generate a desired magnetic field strength with a solenoid of a particular size, a ferromagnetic or ferrimagnetic core will be required. However, such a core will have a magnetic signature. Embodiments as disclosed herein may provide a way of reducing magnetic signature of such a core, when the solenoid is not in use, by raising the temperature of the magnetic core above the Curie temperature and thus substantially eliminating ferro-/ferrimagnetic effects.

The normal operating temperature of the satellite system is likely to be lower than the normal operating temperature of the minesweeping module, thus a different core material may be employed in a satellite system, having a lower Curie temperature. The precise material employed within the core is not particularly limited beyond the requirement that the Curie temperature lies above the normal operating temperature of the satellite system but low enough that it may be heated above the Curie temperature without significant energy expenditure and therefore cost. Typically, a core material having a Curie temperature in the range 5K to 100K will be preferable for a satellite system. It may be preferable that the core material has a Curie temperature which lies in the range 10K to 50K for example. A different set of core materials to those which may be employed in a minesweeping module may be suitable.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A system for emitting a controlled magnetic field, said system comprising:

an electromagnet comprising a magnetic core, wherein the core comprises a ferromagnetic or ferrimagnetic material;

storage means for storing said electromagnet with electrical power of the electromagnet switched off; and heating means for heating said magnetic core, wherein the heating means are operable to heat the magnetic core above its Curie temperature for storage of the electromagnet by said storage means while the electrical power of the electromagnet is switched off.

2. The system of claim 1, wherein the heating means are integral with the storage means.

3. The system of claim 1, wherein the magnetic core is removable from said electromagnet for heating by said heating means.

4. The system of claim 1, wherein the heating means are integral with said magnetic core.

5. The system of claim 1, wherein the Curie temperature of the magnetic core lies in a range 0° C. to 100° C.

6. The system of claim 5, wherein the Curie temperature of the magnetic core lies in a range 50° C. to 100° C.

7. The system of claim 1, wherein the magnetic core comprises a ferrite.

8. The system of claim 7, wherein the magnetic core comprises a single crystal ferrite.

9. The system of claim 1, wherein the magnetic core comprises at least one material selected from manganese arsenide, gadolinium, chromium (IV) oxide, yttrium iron, terbium iron alloy, nickel 30 iron alloy, cuprospinel, nickel manganese alloy with 25% manganese, nickel 70 copper alloy, silverin 400, manganese zinc ferrites, nickel zinc ferrite, manganese copper ferrite, lanthanum strontium manganite, or YAlFe garnet ferrite.

10. The system of claim 1, wherein the storage means form part of a mine countermeasures vessel.

11. The system of claim 1, wherein the electromagnet is comprised within a minesweeping module and wherein the storage means comprises means for storing the minesweeping module.

12. A mine countermeasures system comprising the system of claim 1.

13. A mine countermeasures vessel comprising the system of claim 1.

14. A method of storing an electromagnet, wherein said electromagnet comprises a magnetic core, wherein said magnetic core comprises ferromagnetic or ferrimagnetic material, the method comprising:

switching off electrical power to the electromagnet;

heating the magnetic core to a temperature above the Curie temperature of the magnetic core; and storing the magnetic core at said temperature above the Curie temperature of the magnetic core while the electrical power of the electromagnet is switched off.

15. The method of claim 14, wherein the Curie temperature of the magnetic core lies in a range 0° C. to 100° C.

16. The method of claim 15, wherein the Curie temperature of the magnetic core lies in a range 50° C. to 100° C.

* * * * *